US007479867B2

(12) United States Patent
Kita

(10) Patent No.: US 7,479,867 B2
(45) Date of Patent: Jan. 20, 2009

(54) FUSIBLE LINK RECEPTACLE FOR ELECTRICAL CONNECTOR BOX

(75) Inventor: Yukinori Kita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 268 days.

(21) Appl. No.: 11/117,394

(22) Filed: Apr. 29, 2005

(65) Prior Publication Data

US 2005/0275499 A1 Dec. 15, 2005

(30) Foreign Application Priority Data

Jun. 11, 2004 (JP) ..... 2004-174138

(51) Int. Cl.
*H01H 85/02* (2006.01)
*H01H 85/26* (2006.01)
*H01H 85/20* (2006.01)

(52) U.S. Cl. ..... 337/230; 337/198; 337/284; 337/186

(58) Field of Classification Search ..... 337/186–188, 337/208, 142, 194, 198, 201, 205, 214–215, 337/260, 4, 227, 380, 230, 257, 284; 439/701, 439/949, 76.2, 212, 621; 174/50, 58, 60
See application file for complete search history.

(56) References Cited

U.S. PATENT DOCUMENTS 4,023,264 A * 5/1977 Schmidt et al. ..... 29/623
4,604,602 A * 8/1986 Borzoni ..... 337/264
4,998,086 A * 3/1991 Kourinsky et al. ..... 337/255
5,088,940 A * 2/1992 Saito ..... 439/620.34
5,139,443 A * 8/1992 Armando ..... 439/620.26
5,171,293 A * 12/1992 Umemoto et al. ..... 439/620.33
5,215,479 A * 6/1993 Araki et al. ..... 439/620.33
5,267,493 A * 12/1993 Yamagata et al. ..... 81/3.8
5,416,461 A * 5/1995 Totsuka et al. ..... 337/261
5,631,619 A * 5/1997 Evans ..... 337/198
5,632,654 A * 5/1997 Sugiura ..... 439/620.26

(Continued)

FOREIGN PATENT DOCUMENTS

JP 9-283001 10/1997

(Continued)

OTHER PUBLICATIONS

English Language abstract of JP 2002-335619.

(Continued)

*Primary Examiner*—Jayprakash N Gandhi
*Assistant Examiner*—Bradley H Thomas
(74) *Attorney, Agent, or Firm*—Greenblum & Bernstein, P.L.C.

(57) ABSTRACT

A fusible link receptacle that, when a fusible link is inserted in the receptacle at an inclined angle, prevents both damage to tab connectors and faulty connections between terminals in the fusible link and the tab connectors. Tab connectors extend from internal circuits into the internal region of the fusible link receptacle, and a rib is formed on the internal surface of the perimeter wall and extends to a point above the leading edges of the tab connectors. Should an attempt be made to insert the fusible link into the fusible link receptacle at an inclined angle, the rib makes interfering contact with the lower edge of the fusible link to prevent further insertion.

14 Claims, 11 Drawing Sheets

U.S. PATENT DOCUMENTS

| | | | | |
|---|---|---|---|---|
| 5,647,769 | A * | 7/1997 | Takeuchi | 439/620.27 |
| 5,662,496 | A * | 9/1997 | Kanamori | 439/620.27 |
| 5,680,088 | A * | 10/1997 | Seki et al. | 337/194 |
| 5,795,193 | A * | 8/1998 | Yang | 439/620.27 |
| 5,945,903 | A * | 8/1999 | Reddy et al. | 337/197 |
| 6,159,044 | A | 12/2000 | Kita | |
| 6,388,889 | B1 | 5/2002 | Oka | |
| 6,443,771 | B2 * | 9/2002 | Kondo et al. | 439/620.27 |
| 6,608,546 | B2 * | 8/2003 | Andoh et al. | 337/260 |
| 6,781,503 | B1 * | 8/2004 | Kubota | 337/230 |
| 6,784,365 | B2 | 8/2004 | Ohashi et al. | |
| 6,875,028 | B2 | 4/2005 | Kita et al. | |
| 2003/0188882 | A1 | 10/2003 | Asao et al. | |
| 2004/0155749 | A1 * | 8/2004 | Fujii | 337/187 |
| 2006/0119463 | A1 * | 6/2006 | Kubota | 337/182 |
| 2006/0199404 | A1 * | 9/2006 | Kubota | 439/76.2 |

FOREIGN PATENT DOCUMENTS

| | | |
|---|---|---|
| JP | 2002-335619 | 11/2002 |
| JP | 2004-7912 | 1/2004 |
| JP | 2004-072982 | 3/2004 |

OTHER PUBLICATIONS

English Language abstract of JP 2004-072982.
English Language abstract of JP 9-283001.

* cited by examiner

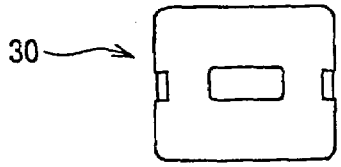
FIG. 3A
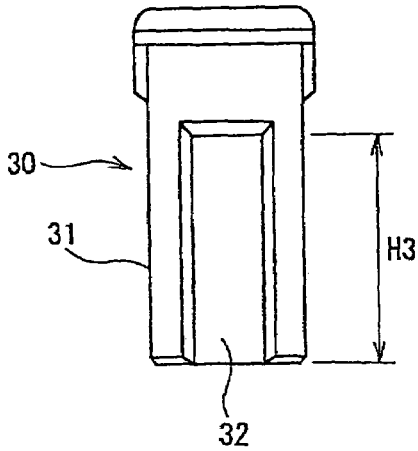
FIG. 3B
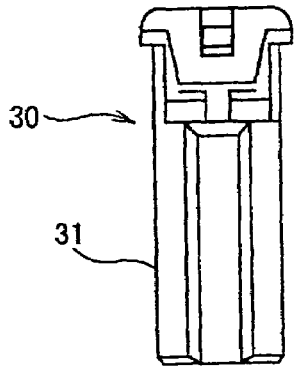
FIG. 3C
FIG. 4A
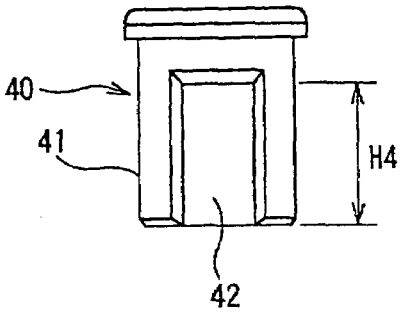
FIG. 4B
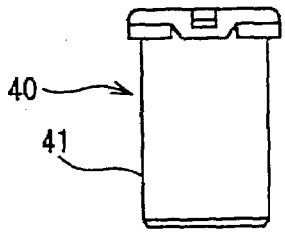

FUSIBLE LINK RECEPTACLE FOR ELECTRICAL CONNECTOR BOX

CROSS REFERENCE TO RELATED APPLICATIONS

The present disclosure relates to subject matter contained in priority Japanese Application No. 2004-174138, filed on Jun. 11, 2004, which is herein expressly incorporated by reference in its entirety.

BACKGROUND OF THE INVENTION

1. Field of the Invention

The invention relates to a fusible link receptacle for an electrical connector box, and more particularly, to a fusible link receptacle that accommodates the selectable insertion of fusible links of various heights.

2. Description of the Background Information

Automotive electrical connector boxes have been conventionally equipped with fusible link receptacles into which push-in type fusible links are installed. It is preferable that the fusible links, though having different height dimensions, have the same cross section on a plane intersecting the height axis at 90 degrees in order to allow either the short or tall fusible link to be selectably inserted into a single type of fusible link receptacle.

Japanese Kokai (laid open) Patent Publication 2004-7912 describes fusible link receptacle 1 shown in FIGS. 11A and 11B. The height of perimeter wall 2 of receptacle 1 exceeds the height of the short fusible link, while either second (tall) fusible link 5 or first (short) fusible link 6 may be inserted in receptacle 1. A pair of tab connectors 4 extend from floor 3 of receptacle 1, and connect to female terminals 7 and 8 of fusible links 5 and 6, respectively, when either of the fusible links is installed in receptacle 1.

Regarding the structure described in Japanese Patent Publication 2004-7912, lowering the height of perimeter wall 2 of receptacle 1 without changing the length of tab connectors 4 results in a decrease in dimension H which is the distance from leading edge 4*a* of tab connectors 4 to upper edge 2*a* of perimeter wall 2.

As shown in FIG. 12A, dimension H' increases if the height of the perimeter wall of receptacle 1 is increased to form a receptacle specifically constructed to accommodate the insertion of a tall second fusible link, dimension H' being the distance from edge 2*a*' of perimeter wall 2' to leading edge 4*a* of tab connectors 4. In this structure, tab connectors 4 do not interferingly contact tall fusible link 5 when tall second fusible link 5 is inserted into receptacle 1' at an inclined angle. Conversely, as shown in FIG. 12B which describes receptacle 1 of Japanese Patent Publication 2004-7912 as having a low perimeter wall 2 height, the inclined insertion of first (short) fusible link 6 into the receptacle 1 results in tab connectors 4 being deformed due to interference contact with first (short) fusible link 6. The further insertion of first fusible link 6 at an inclined angle causes tab connectors 4 to enter fusible link 6 and push terminals 8 (which are housed within fusible link 6) upward, thus displacing terminals 8 and making faulty connection thereto. The same problem is encountered when tall second fusible link 5 is inserted into the receptacle 1.

SUMMARY OF THE INVENTION

In consideration of the shortcomings of the prior art, the present invention includes a construction of a fusible link receptacle into which either a tall fusible link or a short fusible link may be correctly and dependably inserted wherein the insertion of either of the fusible links will not damage the tab connectors in the fusible link receptacle nor cause faulty connection to the terminals therein.

An aspect of the present invention provides a fusible link receptacle for an electrical connector box, the fusible link receptacle provided on an exterior surface of an electrical connector box case to accommodate the selectable insertion of a short first fusible link or a tall second fusible link therein, the fusible link receptacle including a perimeter wall surrounding a base plate and forming an interior region of the fusible link receptacle; tab connectors projecting from the electrical connector box and into the interior region of the fusible link receptacle, the tab connectors forming a portion of internal circuits within the electrical connector box to connect to the fusible link; and a rib provided on an interior surface of the perimeter wall and extending to a point above top edges of the tab connectors, wherein the rib is configured to be inserted into a channel provided within an external wall of either of the first and second fusible links. Further, the rib may extend vertically from the base plate, the channel extending from the edge of an insertion end on an external surface of the first and second fusible links. The rib is positioned above top edges of the tab connectors and extends in the horizontal direction, and the channel is provided as a concave portion positioned opposite the rib on an external surface of the first and second fusible links.

In a further aspect of the present invention, the fusible link receptacle is configured in a rectangular shape in plan view, and the rib is provided on an internal surface of one of the long sides of the receptacle and located opposite to a region between the tab connectors that project into the interior region of the receptacle. Additionally, the fusible link receptacle has substantially the same height as the short first fusible link. Further, the rib may include first and second ribs extending vertically from the base plate, each the rib configured as a planar member; and the channel including a first channel and a second channel, the channels extending from the edge of an insertion end on opposite external surfaces of the first and second fusible links. The rib may include first and second ribs extending vertically from the base plate, each rib configured as a pair of rods; and the channel including a first channel and a second channel, the channels extending from the edge of an insertion end on opposite external surfaces of the first and second fusible links. Further, the rib may include first and second ribs positioned above top edges of the tab connectors and extending in the horizontal direction; and the channel including a first channel and a second channel, the channels provided as concave portions positioned opposite the ribs on opposite external surfaces of the first and second fusible links.

A further aspect of the present invention provides in combination, a fusible link and a fusible link receptacle for an electrical connector box, the fusible link receptacle provided on an exterior surface of an electrical connector box case to accommodate the selectable insertion of a short first fusible link or a tall second fusible link therein, the fusible link receptacle and the fusible link including a perimeter wall surrounding a base plate and forming an interior region of the fusible link receptacle; tab connectors projecting from the electrical connector box and into the interior region of the fusible link receptacle, the tab connectors forming a portion of internal circuits within the electrical connector box to connect to the fusible link; a rib provided on an interior surface of the perimeter wall and extending to a point above top edges of the tab connectors; and a channel provided within an external wall of the fusible link, the rib being inserted into the channel.

When an attempt is made to insert either the first (short) or second (tall) fusible link into the receptacle at an inclined angle, this construction of the present invention causes the rib to come into interfering contact with the lower edge of the fusible link at a location above the tab connectors before the lower edge of the fusible link can interferingly contact the tab connectors, thus preventing further angular insertion of the fusible link. Accordingly, the tab connectors cannot be deformed because the fusible link is prevented from making interfering contact therewith. Moreover, if the fusible link were to be inserted into the receptacle even at a slight inclination, dependable and correctly aligned insertion can be attained due to the tab connectors straightly entering the fusible link case without pushing up against the terminals within the case due to the fusible link being aligned by the interconnection of the rib and channel during insertion of the fusible link into the receptacle.

The inclusion of a rib on an internal surface of the receptacle perimeter wall allows the perimeter wall to be formed to a low height and still accommodate the insertion of either the first (short) or second (tall) fusible link due to the inclined insertion of the fusible link being prevented, and thus the electrical connector box can be used in a wider range of applications.

The construction of the present invention allows either the vertically extending rib, or the rib formed horizontally above the leading edges of the tab connectors, to mate with the channel on the fusible link, therefore forming a mechanism able to guide the fusible link into the receptacle.

Because the fusible link may easily incline along the long axis of the receptacle when inserted therein, the construction of the present invention provides for the formation of a rib on the internal surface of a long side of the perimeter wall to create a mechanism whereby the rib interferingly contacts the lower edge of the fusible link and thus prevents the fusible link from being inserted at an inclined angle. Moreover, while it is acceptable to form a rib on the internal surface of only one perimeter wall, it is advantageous to provide a rib on two perimeter walls. This structure provides more effective means of preventing the inclined insertion of the fusible link due to the ribs interferingly contacting two lower edges of the fusible link when the fusible link is inserted at an inclined angle. Furthermore, because the rib is located opposite the region between the tab connectors and in proximity thereto, a fusible link inserted into the receptacle at an inclined angle interferingly contacts the rib in proximity to the tab connectors, thus preventing interfering contact between the tab connectors and fusible link.

As noted previously, when inserting either the first (tall) or second (short) fusible link into the receptacle at an inclined angle, the rib makes interfering contact with the lower edge of the fusible link at a location above the tab connectors before the lower edge of the fusible link is able to contact the tab connectors, thus preventing further insertion of the fusible link. Distortion of the tab connectors is thus prevented because the fusible link and tab connectors are prevented from mutually interfering contact. If the fusible link were inserted into the receptacle at only a slightly inclined angle, the straightly aligned interconnection formed between the channel and rib correctly aligns the fusible link, guides the tab connectors straightly into the fusible link case, and prevents the tab connectors from pushing up against the case, thus enabling the dependable, correct, and secure connection of the tab connectors to the terminals.

Due to the rib being formed on an internal surface of the external wall of the receptacle and the ability of this structure to prevent inclined insertion of the fusible link, the perimeter wall of the receptacle may be formed to a low height while still accommodating the insertion of the first or second fusible link which are of different heights, thereby allowing the electrical connector box to be used in a wider variety of applications.

BRIEF DESCRIPTION OF THE DRAWINGS

The above, and other objects, features and advantages of the present invention will be made apparent from the following description of the preferred embodiments, given as non-limiting examples, with reference to the accompanying drawings in which:

FIG. 3A is a top plan view of the long fusible link of the embodiment of FIG. 1;

FIG. 3B is a front elevational view of the long fusible link of the embodiment of FIG. 1;

FIG. 3C is a side elevational view of the long fusible link of the embodiment of FIG. 1;

FIG. 4A is a front elevational view of the short fusible link of the embodiment of FIG. 1;

FIG. 4B is a side elevational view of the short fusible link of the embodiment of FIG. 1;

Figure 10A:
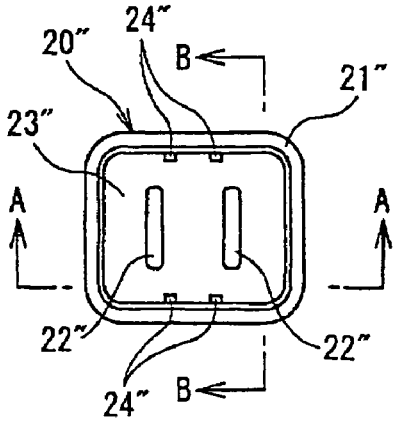
FIG. 10A is a top plan view of a fusible link receptacle according to a third embodiment of the present invention.
Figure 10B:
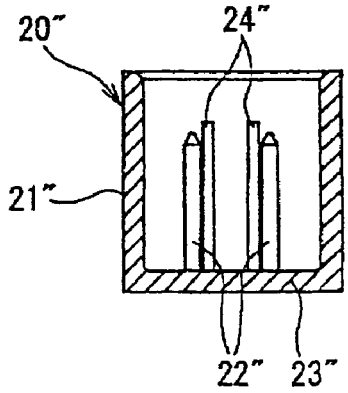
Figure 10C:
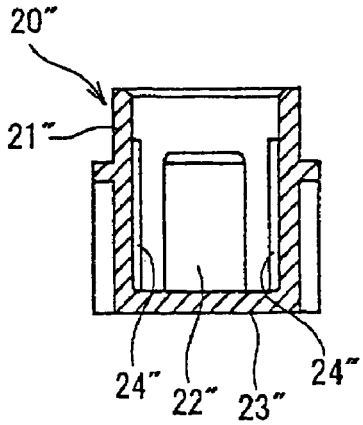
Figure 11A:
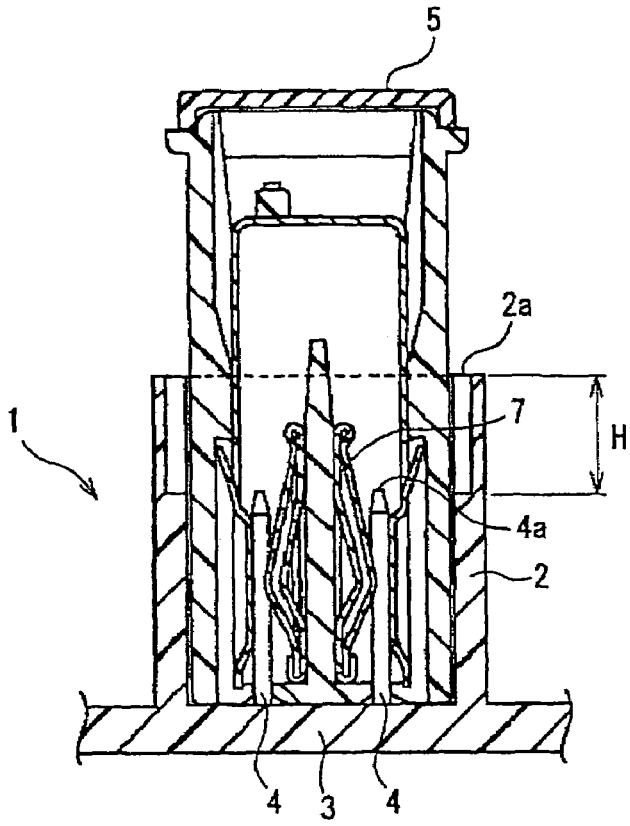
FIG. 11A PRIOR ART
Figure 11B:
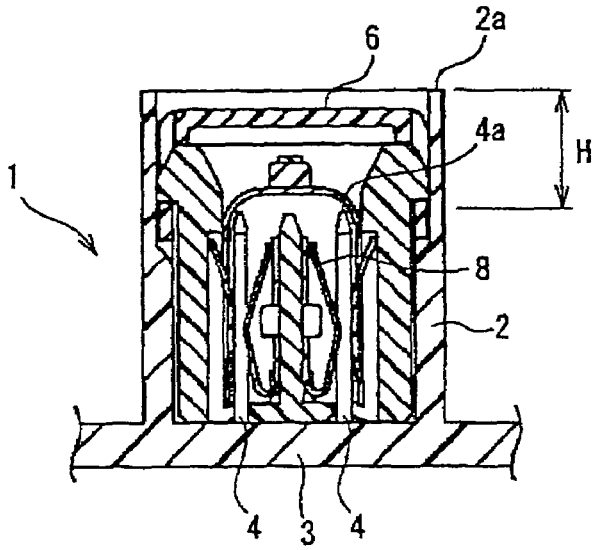
FIG. 11B PRIOR ART
Figure 12A:
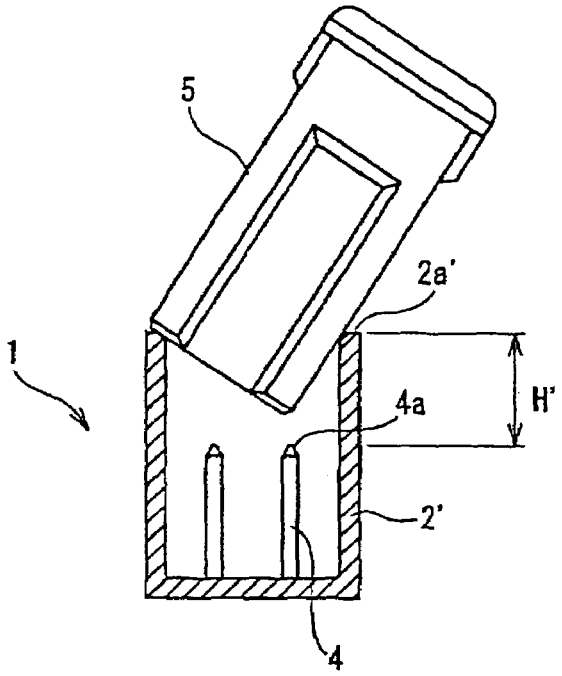
FIG.12A PRIOR ART
Figure 12B:
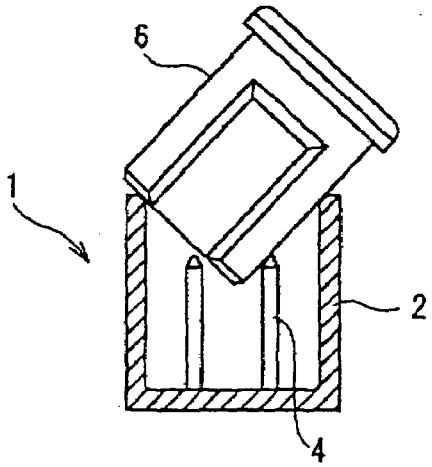
FIG.12B PRIOR ART

FIG. l0B is a cross sectional view taken from line A-A of the fusible link receptacle of the embodiment of FIG. 10A;

FIG. 10C is a cross sectional view taken from line B-B of the fusible link receptacle of the embodiment of FIG. 10A;

FIGS. 11A and 11B show a fusible link receptacle of the prior art;

FIG. 12A shows a long fusible link of the prior art, the long fusible link being angularly inserted into a fusible link receptacle constructed to accommodate only a long fusible link; and FIG. 12B shows a short fusible link receptacle being inserted into a fusible link receptacle constructed to accommodate only a long fusible link.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe embodiments of the invention with reference to the drawings. FIGS. 1 through 7 describe a first embodiment of the present invention wherein an electrical connector box 10 includes a fusible link receptacle 20, multiple fuse receptacles 11, relay receptacles 12, and connector receptacles 13 on the external surface.

Figure 1:
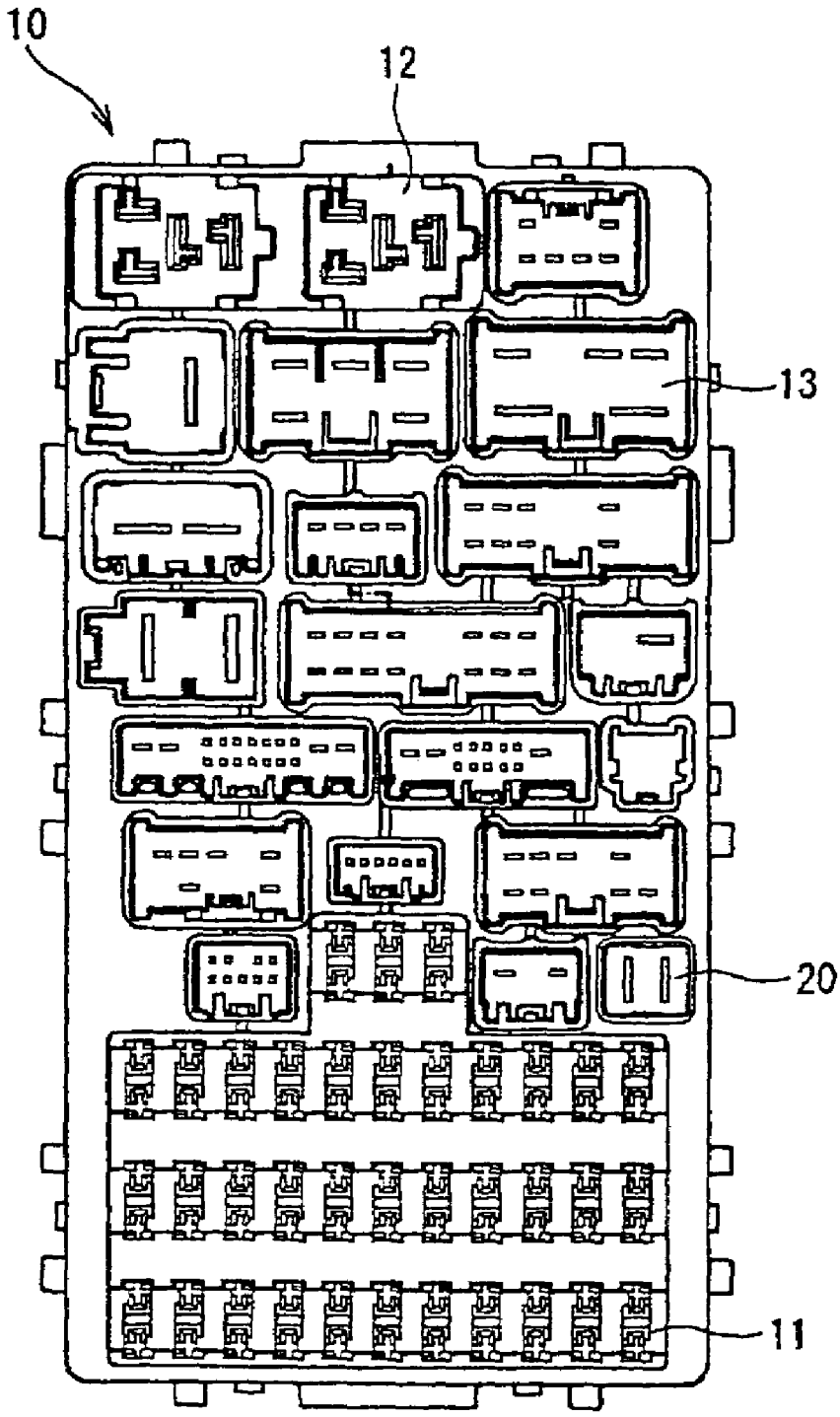
FIG. 1 is a top plan view of a fusible link receptacle of a first embodiment of the present invention.
Figure 2A:
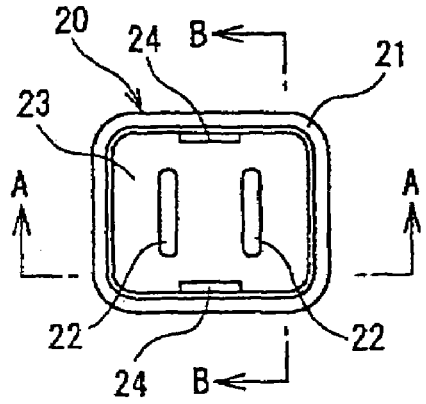
FIG. 2A is a top plan view of the fusible link receptacle of the embodiment of FIG. 1.
Figure 2B:
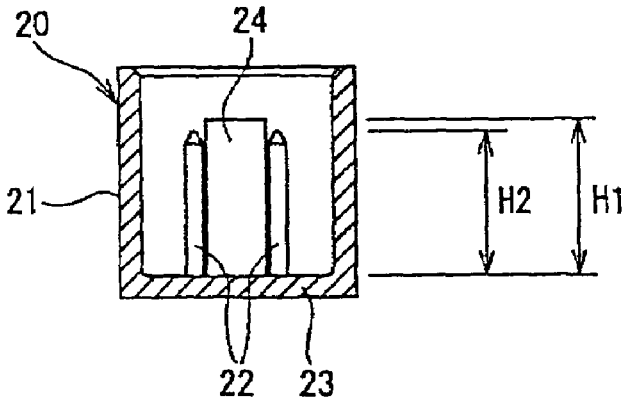
FIG. 2B is a cross sectional view taken from line A-A of the fusible link receptacle of the embodiment of FIG. 1.
Figure 2C:
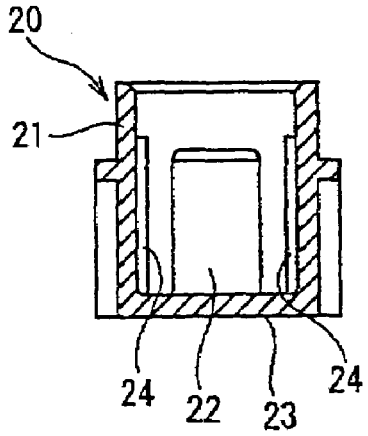
FIG. 2C is a cross sectional view taken from line B-B of the fusible link receptacle of the embodiment of FIG. 1.

As illustrated in FIGS. 2A, 2B, and 2C, fusible link receptacle 20, (hereafter referred to as receptacle 20) is defined by a square frame-shaped perimeter wall 21 provided on the exterior of the electrical connector box 10. Perimeter wall 21 is of the same height as that of first (short) fusible link 40 and will accommodate the insertion of either fusible link 40 or second (tall) fusible link 30 therein. First fusible link 40 and second fusible link 30 will be described subsequently. Within the internal region of receptacle 20 defined by perimeter wall 21 are a pair of tab connectors 22 which connect to a circuit within electrical connector box 10, and which project through terminal slots (not shown in the drawings) formed in base plate 23. The plane along the width direction of tab connectors 22 intersects the long sides of perimeter wall 21 at 90 degrees.

A pair of guide ribs 24 are provided, one guide rib 24 being formed on the inner surface of each of the long sides of perimeter wall 21 to direct the insertion of fusible link 30 or 40 into receptacle 20. Each guide rib 24 is located opposite the region between tab connectors 22, and extends upward form base plate 23 to a point above the leading edges of tab connectors 22. In other words, with the height of rib 24 designated H1, and the projecting height of tab connector 22 designated H2, the relationship between H1 and H2 is expressed as H1>H2.

Second (tall) fusible link 30 and first (short) fusible link 40, either of which may be inserted into receptacle 20, are of different height dimension but have the approximately same rectangular cross section on a plane at a right angle to the height axis. Case 31 is defined by perimeter wall 21 on tall fusible link 30, case 41 by perimeter wall 21 on short fusible link 40 and, as shown in FIGS. 3A-3C and 4A-4B, include channels 32 and 42, respectively, formed on the external surfaces of their long sides. Channels 32 and 42 have the approximate same width as that of rib 24 on perimeter wall 21 of receptacle 20, rib 24 having a depth sufficient to allow its insertion into channels 32 and 42. Moreover, channels 32 and 42 extend from the bottom edge of case 31 and 41 respectively to height dimensions H3 and H4, respectively, which are slightly greater than height dimension H1 of rib 24. Therefore, the upper edges of channels 32 and 34 do not contact rib 24 when tall fusible link 30 or short fusible link 40 is inserted.

Figure 5A:
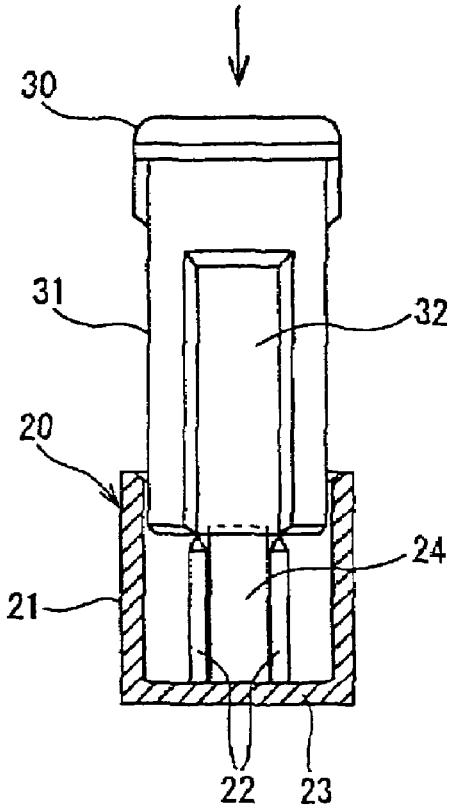
FIG. 5A shows a long fusible link correctly aligned and inserted into the fusible link receptacle of the embodiment of FIG. 1.
Figure 5B:
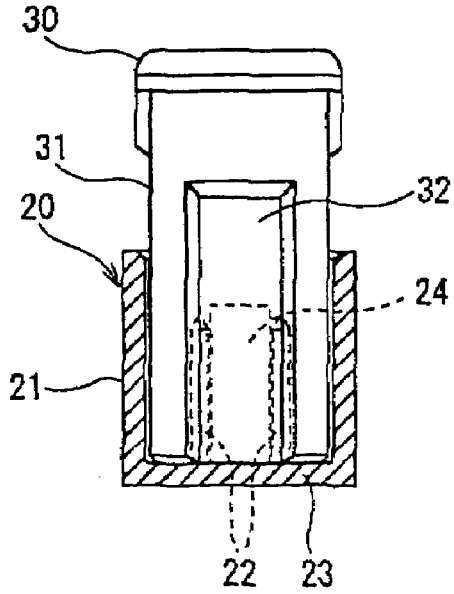
FIG. 5B shows a long fusible link after being connected to the fusible link receptacle of the embodiment of FIG. 1.
Figure 6:
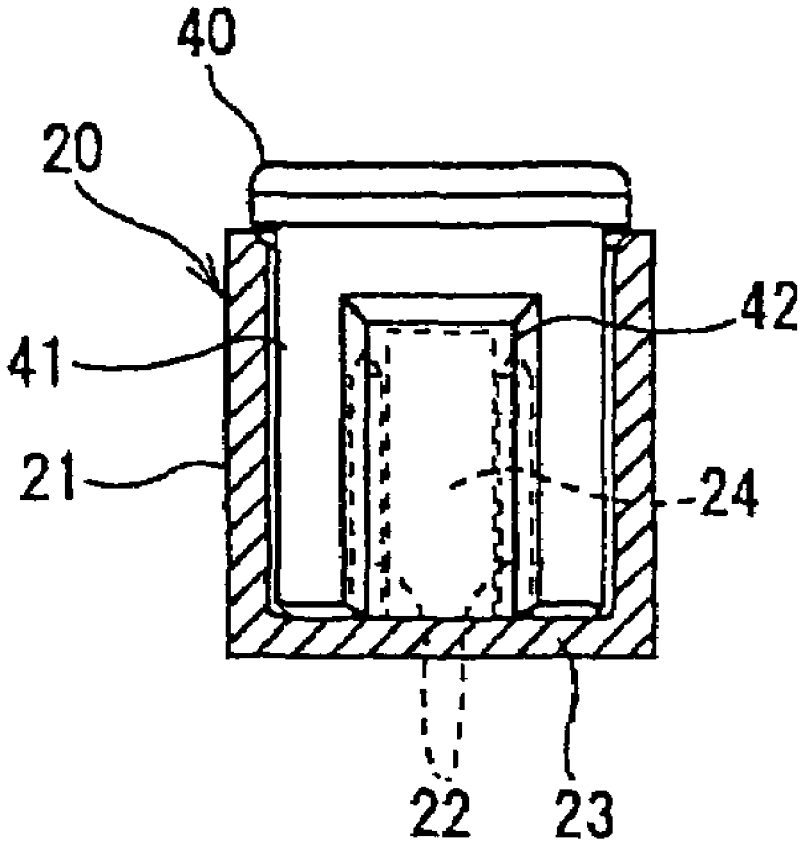
FIG. 6 is a cross sectional view of a short fusible link connected to the fusible link receptacle of the embodiment of FIG. 1.

As illustrated by the structures in FIGS. 5A-5B, and 6, the straightly aligned insertion of fusible link 30 or 40 into receptacle 20 results in rib 24 of receptacle 20 entering channel 32 or 42 of fusible link 30 or 40, after which fusible link 30 or 40 continues to be fully inserted up to the specified connecting position. As this occurs, tab connectors 22 pass through terminal slots (not shown in the drawings) formed in the lower surface of fusible link 30 or 40, and connect to terminals (not shown in the drawings) within case 31 or 41.

Figure 7A:
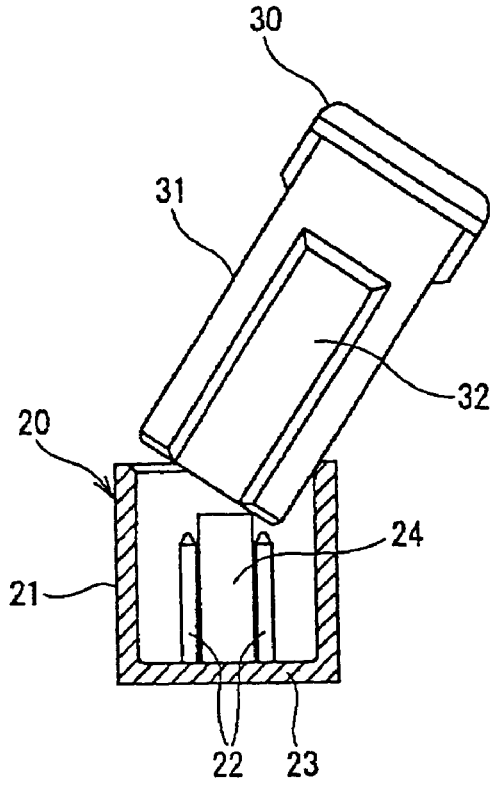
FIG. 7A shows a long fusible link being inserted into the fusible link receptacle of the embodiment of FIG. 1 at an inclined angle.
Figure 7B:
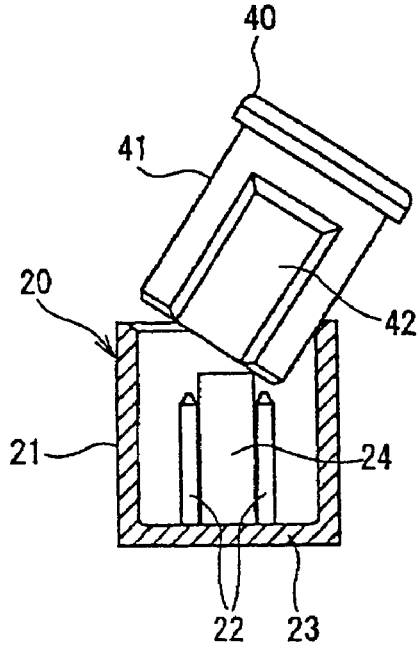
FIG. 7B shows a short fusible link being inserted into the fusible link receptacle of the embodiment of FIG. 1 at an inclined angle.
Figure 8A:
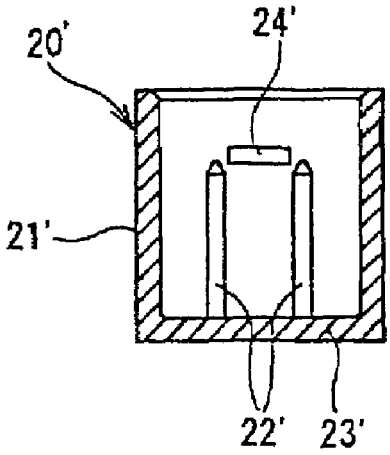
FIG. 8A is a cross sectional view of a fusible link receptacle according to a second embodiment of the present invention.
Figure 8B:
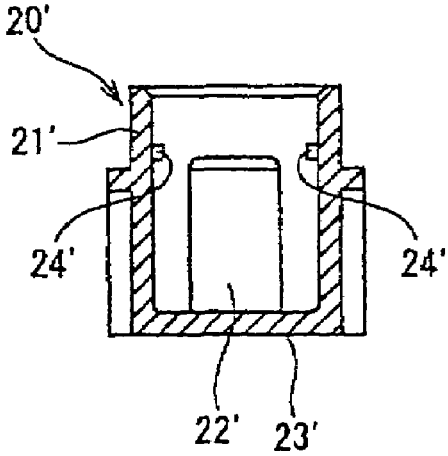
FIG. 8B is a cross sectional view of the fusible link receptacle of the embodiment FIG. 8A.

Conversely, as shown in FIG. 7, when fusible link 30 or 40 is inserted at an angle inclined along the long axis of receptacle 20, rib 24 comes into interfering contact with a part of the bottom edge not at channel 32 or 42 before the bottom edge of tall fusible link 30 or short fusible link 40 is able to come into interfering contact with tab connectors 22, thus preventing fusible link 30 or 40 from being further inserted.

This construction prevents the distortion of tab connectors 22 because tab connectors 22 are prevented from interferingly contacting fusible link 30 or 40 even when the fusible links are inserted into receptacle 20 at an inclined angle. Further, when fusible link 30 or 40 is inserted into receptacle 20 at a slight angle, there is the possibility that tab connectors 22 will push the terminals within the fusible link upward and out of position. However, because the insertion angle of fusible link 30 or 40 is aligned to receptacle 20 by rib 24 entering slot 32 or 42, tab connectors 22 enter case 31 or 41 of fusible link 30 or 40 in a straightly aligned attitude without positionally displacing the terminals within case 31 or 41, thus providing for the correct and dependable connection of tab connectors 22 to the terminals.

Because rib 24, which is located on the inner surface of perimeter wall 21 of receptacle 20, prevents the inclined insertion of fusible link 30 or 40, perimeter wall 21 of receptacle 20 can be formed to a low height dimension and yet still accommodate the insertion of either fusible link 30 or 40, thus widening the application of electrical connector box 10. In addition, while this embodiment specifies that rib 24 be provided or formed on the inner surface of the long side of perimeter wall 21 of receptacle 20, rib 24 may also be provided or formed on an alternative surface such as, for example, the inner surface of the short side of perimeter wall 21, and join to a channel formed on the external surface of the short side of the receptacle case.

FIGS. 8A, 8B, 9A, and 9B describe a second embodiment of the present invention. In this second embodiment, rib 24' of receptacle 20' is shaped differently than that of the first embodiment. One rib of rib pair 24' is formed on the inner surface of each long side of perimeter wall 21' and extends in the length-wise direction at a position above the leading edges of tab connectors 22'. The tab connectors 22' project upwardly from base plate 23'. In the same manner as described in the first embodiment, each rib 24' is positioned opposite to the region between the pair of tab connectors 22'.

Figure 9A:
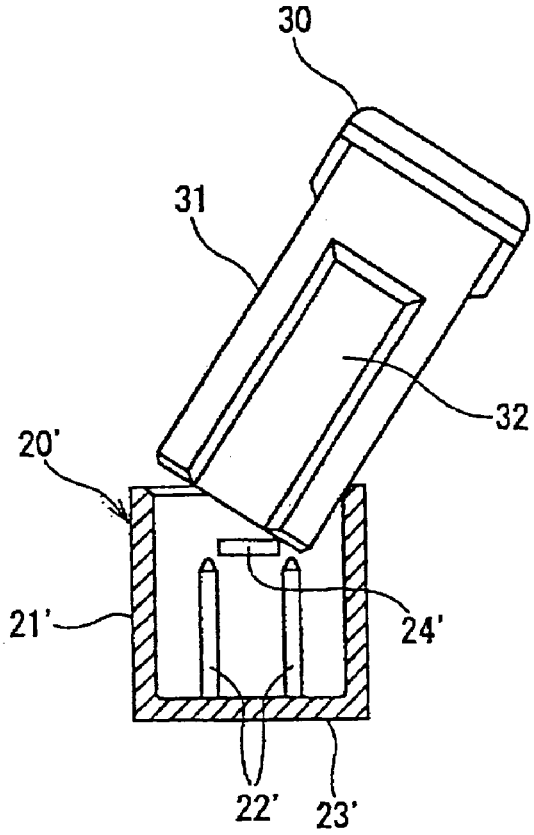
FIG. 9A shows the long fusible link being inserted into the fusible link receptacle of the embodiment of FIG. 8A at an inclined angle.
Figure 9B:
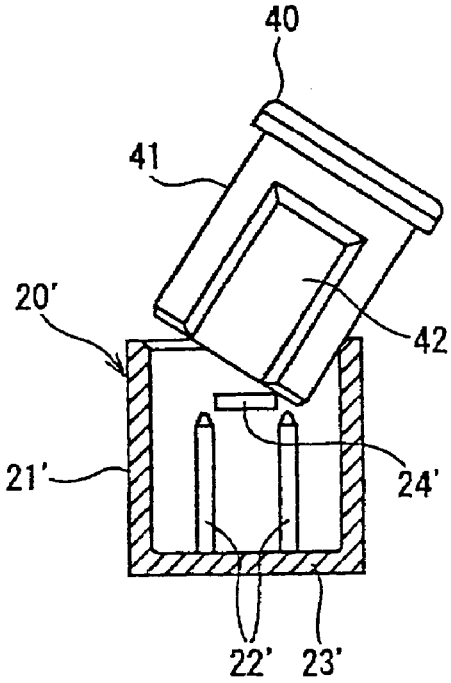
FIG. 9B shows the short fusible link being inserted to the fusible link receptacle of the embodiment of FIG. 8A at an inclined angle.

As shown in FIGS. 9A and 9B, rib 24' prevents the inclined insertion of fusible link 30 and 40 in the same manner as described in the first embodiment. Moreover, second embodiment structures and mechanisms having the same element numbers as those in the first embodiment have been omitted.

FIGS. 10A-10C describe a third embodiment of the present invention. In this third embodiment, the shape of rib 24" differs from that of the first embodiment. Two ribs 24" are formed on the internal surface of each long side of perimeter wall 21" and extend upward from the upper surface of base plate 23" to a point beyond the height of the leading edges of tab connectors 22". Ribs 24" are positioned opposite to and between the pair of tab connectors 22", and form a gap along the lengthwise direction of perimeter wall 21" in the vicinity of tab connectors 22".

In the same manner as described for the first embodiment, ribs 24" in this third embodiment prevent the inclined insertion of fusible link 30 or 40. Furthermore, as the first and third embodiment structures and mechanisms sharing the same element numbers perform the same functions, descriptions of the third embodiment structures and mechanisms have been omitted. Still further, while this embodiment specifies that two ribs 24" be formed on the same inner surface of the external part of the receptacle, three or more ribs may also be provided. In this case, multiple channels may be formed on the external surface of the fusible link case at locations opposing the ribs.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A fusible link receptacle for an electrical connector box, said fusible link receptacle provided on an exterior surface of an electrical connector box case to accommodate the selectable insertion of a short first fusible link or a tall second fusible link therein, said fusible link receptacle comprising:

a perimeter wall surrounding a base plate and forming an interior region of said fusible link receptacle;

tab connectors projecting from the electrical connector box and into said interior region of said fusible link receptacle, said tab connectors forming a portion of internal circuits within the electrical connector box to connect to one of said first and second fusible links; and a rib provided on an interior surface of said perimeter wall and extending to a point above top edges of said tab connectors, wherein said rib is configured to be inserted into a channel provided within an external wall of said first and second fusible links, said rib having substantially the same width as the channels within the external wall of said first and second fusible links, and said rib having a depth projecting from the interior surface of said perimeter wall sufficient to be inserted into the channel within the external wall of said first and second fusible links;

wherein said rib is positioned opposite to and between said tab connectors that project into the interior region of said fusible link receptacle.

2. The fusible link receptacle according to claim 1, wherein said rib extends vertically from said base plate, and said channel extends from an edge of an insertion end on an external surface of either of said first and second fusible links.

3. The fusible link receptacle according to claim 2, said rib comprising:

first and second ribs extending vertically from said base plate, each said rib configured as a planar member; and said channel includes a first channel and a second channel, said channels extending from an edge of an insertion end on opposite external surfaces of either of said first and second fusible links.

4. The fusible link receptacle according to claim 2, said rib comprising:

first and second ribs extending vertically from said base plate, each said rib configured as a pair of rods; and said channel includes a first channel and a second channel, said channels extending from an edge of an insertion end on opposite external surfaces of either of said first and second fusible links.

5. The fusible link receptacle according to claim 1, wherein said rib is positioned above top edges of said tab connectors and extends in the horizontal direction, and said channel is provided as a concave portion positioned opposite said rib on an external surface of either of said first and second fusible links.

6. The fusible link receptacle according to claim 5, said rib comprising:

first and second ribs positioned above top edges of said tab connectors and extending in the horizontal direction; and said channel includes a first channel and a second channel, said channels provided as concave portions positioned opposite said ribs on opposite external surfaces of either of said first and second fusible links.

7. The fusible link receptacle according to claim 1, wherein said fusible link receptacle is configured in a rectangular shape in plan view, and said rib is provided on an internal surface of one of the long sides of the fusible link receptacle.

8. The fusible link receptacle according to claim 1, wherein said fusible link receptacle has substantially the same height as the short first fusible link.

9. In combination, a fusible link and a fusible link receptacle for an electrical connector box, the fusible link receptacle provided on an exterior surface of an electrical connector box case to accommodate the selectable insertion of a short first fusible link or a tall second fusible link therein, said fusible link receptacle and one of said first and second fusible links comprising:

one of a short first fusible link and a tall second fusible link;

a perimeter wall surrounding a base plate and forming an interior region of said fusible link receptacle;

tab connectors projecting from the electrical connector box and into said interior region of said fusible link receptacle, said tab connectors forming a portion of internal circuits within the electrical connector box to connect to one of said first and second fusible links;

a rib provided on an interior surface of said perimeter wall and extending to a point above top edges of said tab connectors; and a channel provided within an external wall of said first and second fusible links, said rib being inserted into said channel, said rib having substantially the same width as the channels within the external wall of said first and second fusible links, and said rib having a depth projecting from the interior surface of said perimeter wall sufficient to be inserted into the channel within the external wall of said first and second fusible links;

wherein said rib is positioned opposite to and between said tab connectors that project into the interior region of said fusible link receptacle.

10. The fusible link and fusible link receptacle combination according to claim 9, wherein said rib extends vertically from said base plate, and said channel extends from an edge of an insertion end on an external surface of either of said first and second fusible links.

11. The fusible link receptacle according to claim 10, said rib comprising:

first and second ribs extending vertically from said base plate, each said rib configured as a planar member; and said channel includes a first channel and a second channel, said channels extending from the edge of an insertion end on opposite external surfaces of one of said first and second fusible links.

12. The fusible link receptacle according to claim 10, said rib comprising:

first and second ribs extending vertically from said base plate, each said rib configured as a pair of rods; and said channel includes a first channel and a second channel, said channels extending from the edge of an insertion end on opposite external surfaces of one of said first and second fusible links.

13. The fusible link receptacle according to claim 9, wherein said rib is positioned above top edges of said tab connectors and extends in the horizontal direction, and said channel is provided as a concave portion positioned opposite said rib on an external surface of either of said first and second fusible links.

14. The fusible link receptacle according to claim 13, said rib comprising:

first and second ribs positioned above top edges of said tab connectors and extending in the horizontal direction; and said channel includes a first channel and a second channel, said channels provided as concave portions positioned opposite said ribs on opposite external surfaces of one of said first and second fusible links.

* * * * *